US008123595B2

(12) United States Patent
Pelotte

(10) Patent No.: US 8,123,595 B2
(45) Date of Patent: Feb. 28, 2012

(54) DRESSING APPARATUS FOR FLEX-ARM MOUNTED GRINDING WHEEL

(75) Inventor: Lawrence John Pelotte, Georgetown, KY (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 917 days.

(21) Appl. No.: 12/145,561

(22) Filed: Jun. 25, 2008

(65) Prior Publication Data

US 2009/0320818 A1 Dec. 31, 2009

(51) Int. Cl.
*B24B 1/00* (2006.01)

(52) U.S. Cl. ..... 451/56; 451/443

(58) Field of Classification Search ..... 451/56, 451/31, 443

See application file for complete search history.

(56) References Cited

U.S. PATENT DOCUMENTS

| | | | | |
|---|---|---|---|---|
| 2,137,690 | A | 11/1938 | Kropf | |
| 2,199,149 | A * | 4/1940 | Broberg | 125/11.15 |
| 2,340,192 | A * | 1/1944 | Locke | 125/11.06 |
| 2,345,821 | A | 4/1944 | Kopec | |
| 2,377,822 | A * | 6/1945 | Starn | 125/11.19 |
| 2,388,216 | A | 10/1945 | Nachemov | |
| 2,468,921 | A | 5/1949 | Bruce | |
| 2,591,434 | A | 4/1952 | Hrankowski | |
| 2,726,650 | A | 12/1955 | Failla | |
| 2,832,329 | A | 4/1958 | Newbould | |
| 2,919,689 | A * | 1/1960 | Burkhart | 125/11.06 |
| 2,926,652 | A | 3/1960 | Duncan | |
| 3,081,762 | A | 3/1963 | Smith | |
| 3,301,247 | A | 1/1967 | Pasowicz | |
| 4,202,317 | A | 5/1980 | Kushigian | |
| D256,091 | S | 7/1980 | Fernandez | |
| 4,291,666 | A | 9/1981 | Garner | |
| 4,303,054 | A * | 12/1981 | Lore | 125/11.01 |
| 5,000,061 | A | 3/1991 | Shepherd | |
| 5,033,447 | A | 7/1991 | Schulze | |
| D349,226 | S | 8/1994 | Ruyts | |
| 5,441,449 | A | 8/1995 | Hart | |
| 6,116,989 | A | 9/2000 | Balastik | |
| 6,827,071 | B2 | 12/2004 | Eason | |

FOREIGN PATENT DOCUMENTS

| | | | |
|---|---|---|---|
| JP | 11216670 | A * | 8/1999 |
| WO | WO 9738822 | A1 * | 10/1997 |

* cited by examiner

*Primary Examiner* — Maurina Rachuba
(74) *Attorney, Agent, or Firm* — Dinsmore & Shohl LLP

(57) ABSTRACT

An apparatus for dressing a grinding wheel mounted on a flex-arm, the apparatus including a base, a post, a dresser and a guide, wherein when the flex-arm is in an unengaged position with the apparatus, the flex-arm is capable of movement along at least two directional axes, and wherein when the flex-arm is in an engaged position with the apparatus, the flex-arm is restricted to movement along one directional axis.

19 Claims, 4 Drawing Sheets

DRESSING APPARATUS FOR FLEX-ARM MOUNTED GRINDING WHEEL

TECHNICAL FIELD

The invention relates to apparatuses utilized in dressing flex-arm mounted grinding wheels.

BACKGROUND

Surfaces that have been accurately ground are often necessary in manufacturing processes. The accuracy of ground surfaces depends heavily upon the shaped precision of an employed grinding wheel. To facilitate this grinding wheel preciseness, dressing apparatuses are regularly utilized to remove grinding medium from a wheel and shape the wheel appropriately. However, for applications in which the grinding wheel is mounted to a flex-arm, dressing the grinding wheel is often difficult due to the dynamism provided by the flex-arm.

SUMMARY

One embodiment of an apparatus for dressing a grinding wheel mounted on a flex-arm includes a base, a post, a dresser and a guide, wherein when the flex-arm is in an unengaged position with the apparatus, the flex-arm is capable of movement along at least two directional axes, and wherein when the flex-arm is in an engaged position with the apparatus, the flex-arm is restricted to movement along one directional axis.

Another embodiment of an apparatus for dressing a grinding wheel mounted on a flex-arm includes a base with at least one magnet mounted on or within the base, a post with at least one aperture, a dresser comprising a bolt and a dressing element, and a guide, wherein when the flex-arm is in an unengaged position with the apparatus, the flex-arm is capable of movement along at least two directional axes, and wherein when the flex-arm is in an engaged position with the apparatus, the flex-arm is restricted to movement along one directional axis.

One embodiment of a method of dressing a grinding wheel that is mounted on a flex-arm capable of movement along at least two directional axes includes providing a dressing apparatus comprising a base, a post, a dresser and a guide, engaging the flex-arm and the dressing apparatus by urging a nose of the flex-arm into contact with the guide so that the flex-arm is restricted to movement along one directional axis, and dressing the grinding wheel by contacting the grinding wheel with the dresser while the grinding wheel is spinning.

These and additional features can be more fully understood in view of the following detailed description, in conjunction with the drawings.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION

Figure 1:
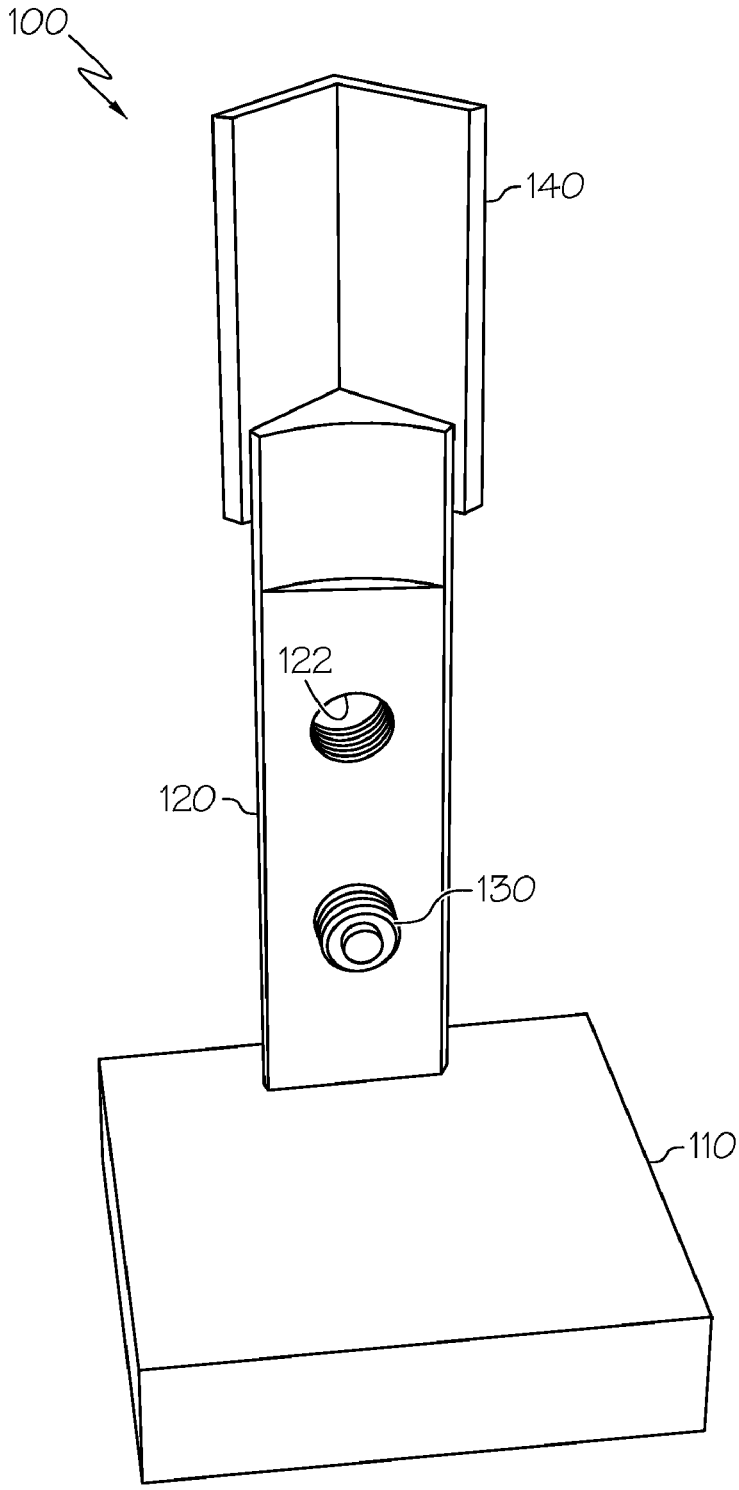
FIG. 1 is a perspective view of an exemplary dressing apparatus according to one embodiment of the present invention.

As will be discussed in relation to the figures, embodiments of dressing apparatus 100 may include base 110, post 120, dresser 130 and guide 140. It should be understood, however, that other embodiments of dressing apparatus 100 may include additional structure.

Figure 2:
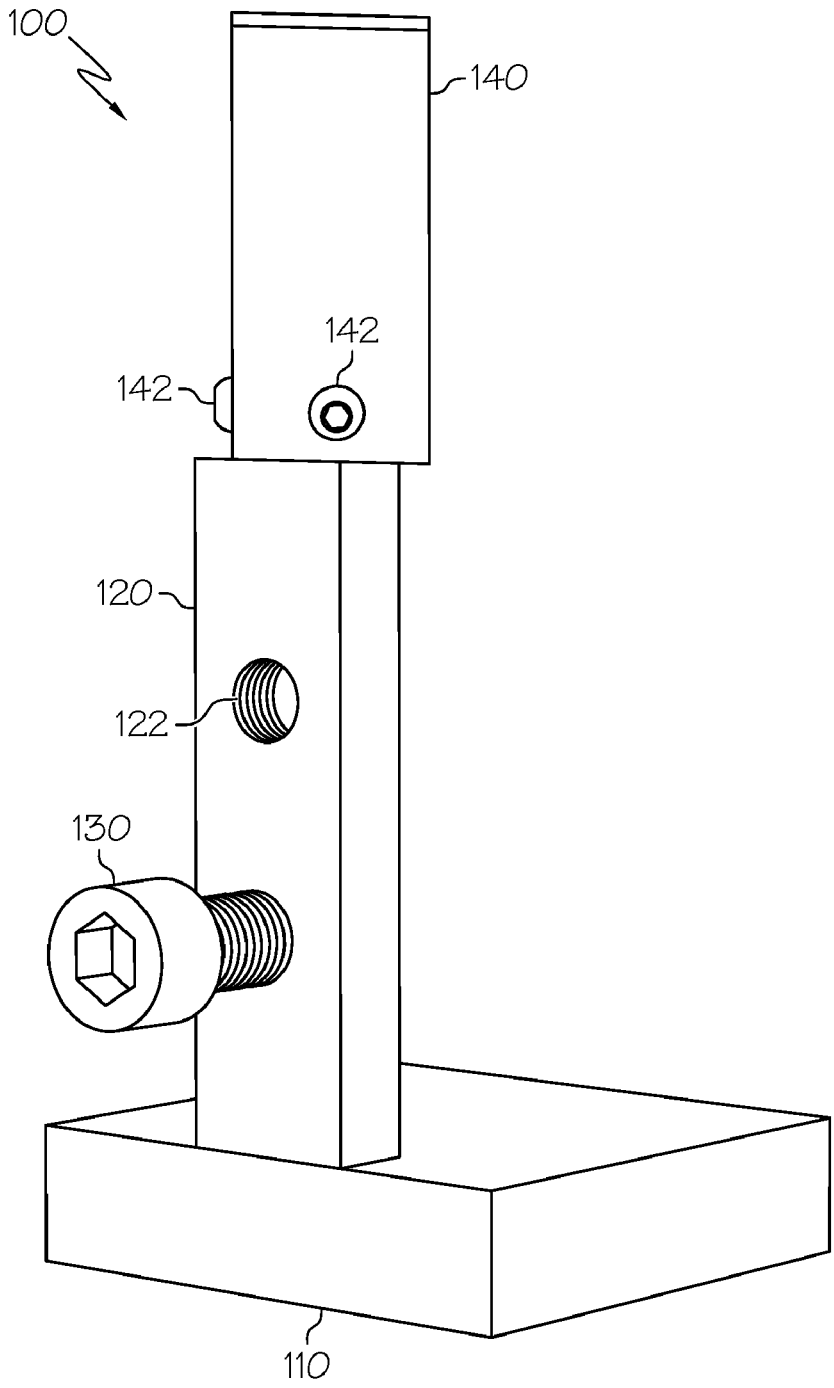
FIG. 2 is a perspective view of the embodiment illustrated in FIG. 1.

Referring to FIGS. 1 and 2, base 110 may be utilized in the stabilization or attachment of dressing apparatus 100 to a surface. Base 110 may take any shape and may stabilize or attach dressing apparatus 100 to a surface by any method now or hereafter known in the art. In the illustrated embodiment, base 110 is a plate with magnets (not shown) mounted therein. Through employment of the magnets, base 110 may be utilized to stabilize and/or attach dressing apparatus 100 to a metal surface plate or metal die. However, other embodiments of dressing apparatus 100 may include a base that solely makes use of the weight of the base and the dressing apparatus for stabilization on a surface. Further embodiments of dressing apparatus 100 may include a base that employs one or more fasteners to attach and stabilize dressing apparatus 100 on a surface. Additional embodiments of dressing apparatus 100 may include a base for permanent attachment and stabilization of dressing apparatus 100 on a surface through welding, soldering, adhering or bonding.

Still referring to FIGS. 1 and 2, post 120 may be utilized to connect base 110 to guide 140, as well as provide support to dresser 130. In the illustrated embodiment, the bottom of post 120 is attached to base 110 through utilization of at least one fastener (not shown). However, any other method of attachment now or hereafter known in the art may also be used, including but not limited to, welding, soldering, adhering or bonding. In additional embodiments of dressing apparatus 100, base 110 and post 120 may be formed together in a one-piece construction. In the illustrated embodiment, the top of post 120 is attached to guide 140 through utilization of fasteners 142. However, any other method of attachment now or hereafter known in the art may also be used, including but not limited to, welding, soldering, adhering or bonding. In additional embodiments of dressing apparatus 100, post 120 and guide 130 may be formed together in a one-piece construction. Additionally, further embodiments of dressing apparatus 100 may include base 110, post 120 and guide 130 formed together in a one-piece construction.

Post 120 may also include one or more apertures for supporting dresser 130. The illustrated embodiment of dressing apparatus 100 includes post 120 with two apertures 122, both of which are threaded for cooperation with a threaded dresser (the drawings show dresser 130 engaged within the lower aperture of post 120, and therefore, only the upper aperture of post 120 is shown). However, in alternate embodiments of dressing apparatus 100, post 120 may include any number of aperture(s) 122. Other embodiments may exclude apertures 122 all together. Further, in embodiments of dressing apparatus 100 that include aperture(s) 122, the aperture(s) need not be threaded. Accordingly, any method or structure now or hereafter known in the art may be utilized to support and/or adjust the position of dresser 130.

Figure 3:
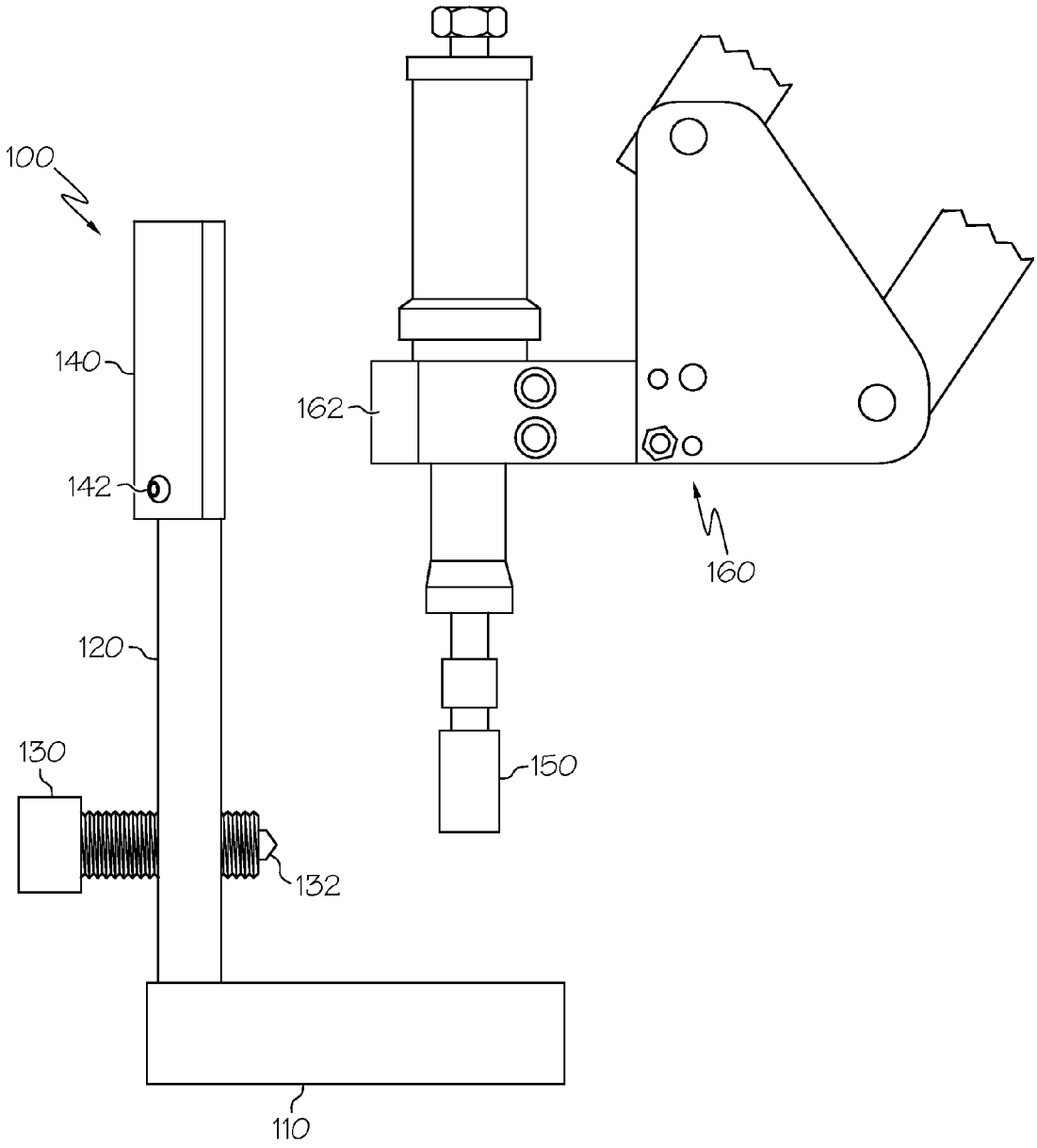
FIG. 3 is a side view of the embodiment illustrated in FIG. 1, further depicting an unengaged flex-arm grinding wheel.
Figure 4:
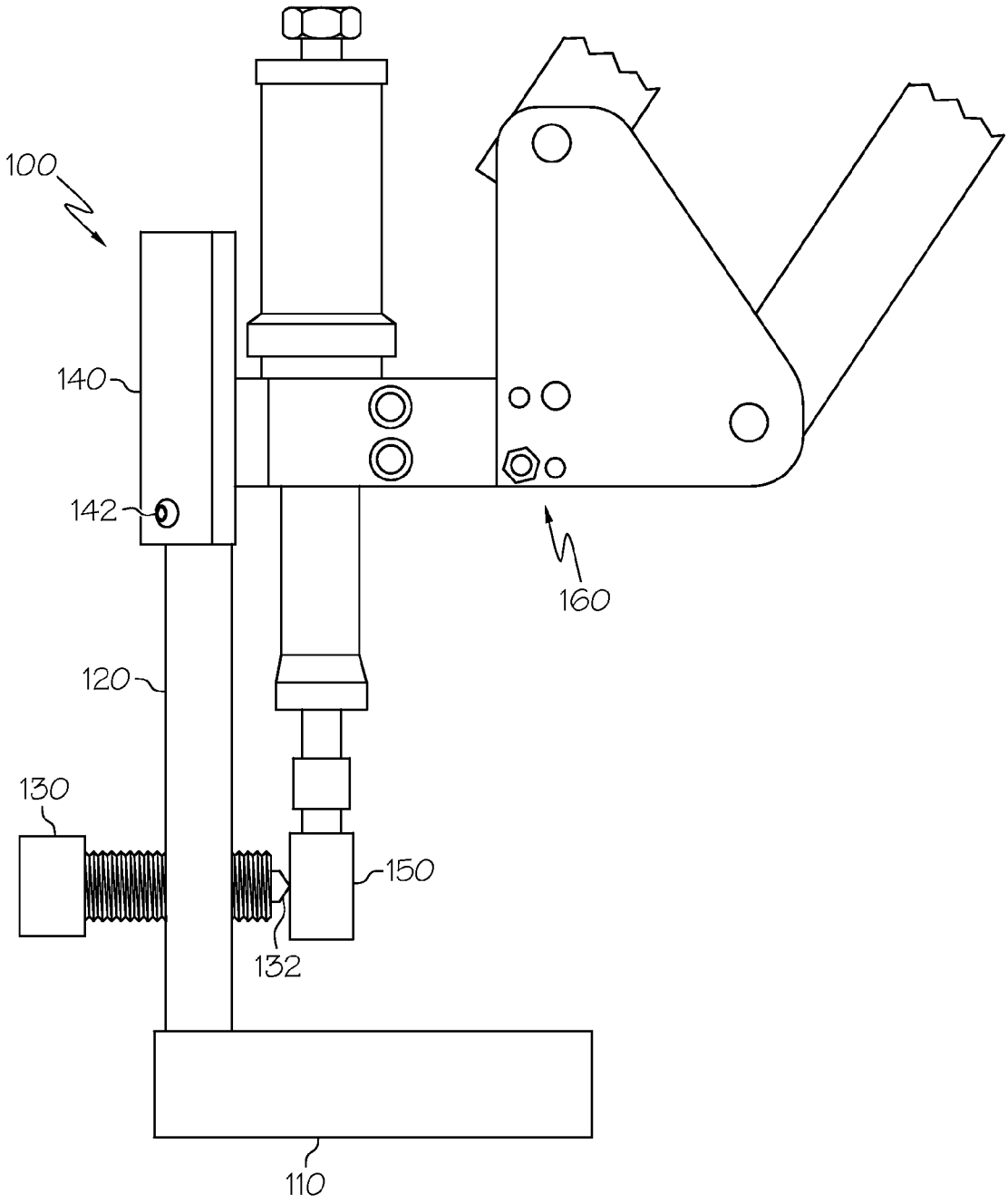
FIG. 4 is a side view of the embodiment illustrated in FIG. 1, further depicting an engaged flex-arm grinding wheel.

Referring to FIGS. 3 and 4, dresser 130 may be utilized to dress grinding wheel 150 while the wheel is spinning. Dresser 130 may be any structure now or hereafter known in the art that may be utilized to shape a rotating grinding wheel by removing grinding medium from the wheel. The illustrated embodiment shows dresser 130 that comprises a threaded bolt with dressing element 132 positioned at the end of the bolt. Dressing element 132 may comprise a diamond or any other hard/durable material now or hereafter know in the art that is useful in dressing grinding wheels. Referring back to FIGS. 1 and 2, the illustrated embodiment includes dresser 130 that is threaded to cooperate with threaded apertures 122 of post 120, and may be rotated through utilization of an Allen wrench (as depicted in FIG. 2). Rotation of dresser 130 in one direction will advance dresser 130 through aperture 122, and rotation of dresser 130 in the opposite direction will retract dresser 130 through aperture 122. However, in alternate embodiments of dressing apparatus 100, dresser 130 need not be threaded. As set forth above, any method or structure now or hereafter known in the art can be utilized to support and/or adjust the position of dresser 130.

Referring to FIGS. 3 and 4, guide 140 may be utilized to direct grinding wheel 150 into an appropriate position for dressing, and may encompass any structure now or hereafter known in the art that may be utilized for that purpose. Moreover, guide 140 may be utilized to restrict flex-arm 160 (and thus also grinding wheel 150) from movement in a particular direction or directions, such as up and down, side to side and forward and back. As shown in FIG. 1, the illustrated embodiment depicts guide 140 that comprises a section of angle iron. In that embodiment, the angle iron includes a vertical channel or recess that nose 162 of flex-arm 160 may travel within. Alternate embodiments of dressing apparatus 100 may include guide 140 that comprises various structures that guide movement of flex-arm 160. Non-limiting examples include angle iron at various angles, channeled structures and structures that further include tracks and/or grooves. Additionally, guide 140 and/or post 120 may further include a stop to keep grinding wheel 150 from contacting base 110 during the dressing operation.

The structure of dressing apparatus 100, including the structure of the individual components (for example, base 110, post 120, dresser 130 and guide 140), may be composed of any suitable material, or combination of materials, now or hereafter known in the art. Non-limiting examples include steel, iron, aluminum, titanium and any other various metal or alloy. The illustrated embodiments are constructed of steel. However, it is not necessary for all individual components of the embodiments of dressing apparatus 100 to be composed of the same material. Certain embodiments of dressing apparatus 100 include components made from different materials, such as embodiments made of both steel and aluminum.

A flex-arm is generally capable of movement along multiple directional axes. Herein, the term "flex-arm" means any mechanical arm or boom that is capable of movement along at least two directional axes. As depicted in FIGS. 3 and 4, and for purposes of non-limiting illustration only, flex-arm 160 is capable of moving in the directional axes of forward and backward, side to side and up and down. Accordingly, grinding wheel 150 mounted to flex-arm 160 is also capable of moving in the directional axes of forward and backward, side to side and up and down. However, when grinding wheel 150 is dressed, it is preferable to restrict the dynamism of grinding wheel 150 (and thus also flex-arm 160) to movement in a single directional axis to ensure more precise dressing. In particular non-limiting applications, a user seeks to keep grinding wheel 150 as vertical (i.e., perpendicular to the bottom of base 110) as possible during dressing. Accordingly, use of the illustrated embodiment of dressing apparatus 100 allows a user to keep grinding wheel 150 as vertical as possible by restricting grinding wheel 150 to only movement along a vertical directional axis during dressing.

When utilizing dressing apparatus 100, a user directs flex-arm 160 from an unengaged position (as depicted in FIG. 3) to an engaged position (as depicted in FIG. 4) with dressing apparatus 100. In the illustrated embodiment, when flex-arm 160 is in an engaged position with dressing apparatus 100, nose 162 of flex-arm 160 is urged within the channel or recess of guide 140. Herein, "urged" means that a slight force is continually exerted on flex-arm 160 towards guide 140 to ensure constant contact between nose 162 and guide 140. Accordingly, once nose 162 of flex-arm 160 is urged within the channel or recess of guide 140, the front to back and side to side movement of grinding wheel 150 is inhibited. Thus, while flex-arm 160 is in an engaged position with dressing apparatus 100, grinding wheel 150 is restricted to movement along only a vertical directional axis, as nose 162 of flex-arm 160 may only travel upward and downward within guide 140. Obviously, depending on the particular application, flex-arms in engaged positions with other embodiments of dressing apparatus 100 may be restricted to movement in different directional axes than the non-limiting illustrated example.

In the illustrated example, when flex-arm 160 is in an engaged position with dressing apparatus 100, grinding wheel 150 may be guided downward towards base 110, passing dressing element 132 of dresser 130. As set forth above in paragraph, rotation of dresser 130 will advance or retract dresser 130 through aperture 122, and therefore also advance or retract dressing element 132 into or out of the path of grinding wheel 150. While spinning, grinding wheel 150 may be guided into dressing element 132 for removal of an amount of grinding medium. If desired, dressing element 132 can be advanced further to remove more grinding medium from grinding wheel 150. Because the illustrated embodiment of dressing apparatus 100 restricts grinding wheel 150 to only movement in a vertical directional axis, grinding wheel 150 may be more precisely and accurately dressed.

The foregoing description of various embodiments of the invention has been presented for the purposes of illustration and description. It is not intended to be exhaustive or to limit the invention to the precise form disclosed. Many alternatives, modifications and variations will be apparent to those skilled in the art of the above teaching. While some of the diverse embodiments of the dressing apparatus have been discussed specifically, other embodiments will be apparent or relatively easily developed by those of ordinary skill in the art. Accordingly, this invention is intended to embrace all alternatives, modifications and variations that have been discussed herein, and others that fall within the spirit and broad scope of the claims.

What is claimed:

1. An apparatus for dressing a grinding wheel mounted on a flex-arm, the apparatus comprising a base, a post, a dresser and a guide receiving a nose of the flex-arm such that the flex-arm is guided by the guide, wherein:

a bottom of the post is positioned on the base;

the guide is positioned on the top of the post and vertically oriented, the guide receiving a nose of the flex arm such that the nose of the flex arm travels within the guide thereby positioning the grinding wheel for dressing with the dresser;

the dresser is positioned in the post below the guide;

wherein when the flex-arm is in an unengaged position with the guide, the flex-arm is capable of movement along at least two directional axes; and wherein when the flex-arm is in an engaged position with the guide, the flex-arm is restricted to movement along one directional axis.

2. The apparatus of claim 1, wherein the base further comprises at least one magnet.

3. The apparatus of claim 1, wherein the post further comprises at least one aperture.

4. The apparatus of claim 3, wherein the at least one aperture and the dresser further comprise threads for cooperation with each another.

5. The apparatus of claim 4, wherein the dresser comprises a threaded bolt and a dressing element.

6. The apparatus of claim 5, wherein the dressing element comprises a diamond.

7. The apparatus of claim 1, wherein the guide further comprises a recess, a channel or a groove for a nose of the flex-arm to enter and travel within.

8. The apparatus of claim 7, wherein the guide comprises a section of angle iron.

9. A method of dressing a grinding wheel that is mounted on a flex-arm capable of movement along at least two directional axes, the method comprising:

providing a dressing apparatus comprising a base, a post, a dresser and a guide;

engaging the flex-arm and the dressing apparatus by urging a nose of the flex-arm into contact with the guide so that the flex-arm is restricted to movement along one directional axis; and dressing the grinding wheel by contacting the grinding wheel with the dresser while the grinding wheel is spinning.

10. The method of claim 9, wherein the flex-arm is capable of movement along three directional axes when not engaged with the dressing apparatus.

11. The method of claim 9, wherein the guide further comprises a recess, a channel or a groove for the nose of the flex-arm to enter and travel within.

12. The method of claim 11, wherein the guide comprises a section of angle iron.

13. The method of claim 9, wherein the base further comprises at least one magnet.

14. The method of claim 13, further comprising the step of securing or attaching the dressing apparatus to a metal table or metal die by setting the base down on upon the metal table or the metal die.

15. An apparatus for dressing a grinding wheel mounted on a flex-arm, the apparatus comprising:

a base with at least one magnet mounted on or within the base;

a post positioned on the base, the post comprising at least one aperture;

a dresser positioned in the post, the dresser comprising a bolt and a dressing element; and a guide positioned on to of the post and vertically oriented such that the dresser is positioned below the guide, the guide receiving a nose of the flex arm such that the nose of the flex arm travels within the guide thereby positioning the grinding wheel for dressing with the dresser;

wherein when the flex-arm is in an unengaged position with the guide, the flex-arm is capable of movement along at least two directional axes; and wherein when the flex-arm is in an engaged position with the guide, the flex-arm is restricted to movement along one directional axis.

16. The apparatus of claim 15, wherein the at least one aperture and the bolt further comprise threads for cooperation with one another.

17. The apparatus of claim 15, wherein the dressing element comprises a diamond.

18. The apparatus of claim 15, wherein the guide comprises a recess, a channel or a groove which receives the nose of the flex-arm.

19. The apparatus of claim 18, wherein the guide comprises a section of angle iron.

* * * * *

UNITED STATES PATENT AND TRADEMARK OFFICE

CERTIFICATE OF CORRECTION

PATENT NO. : 8,123,595 B2
APPLICATION NO. : 12/145561
DATED : February 28, 2012
INVENTOR(S) : Pelotte It is certified that error appears in the above-identified patent and that said Letters Patent is hereby corrected as shown below:

Claim 15, column 6, line 17, change “to” to “top”.

Signed and Sealed this
Third Day of April, 2012

David J. Kappos

David J. Kappos
*Director of the United States Patent and Trademark Office*